United States Patent [19]

Dufault

[11] 4,228,748

[45] Oct. 21, 1980

[54] THREAD CONTROL FOR BUTTONHOLE SEWING MACHINE

[76] Inventor: Armand A. Dufault, P.O. Box 92, Somerset, Mass. 02726

[21] Appl. No.: 89,566

[22] Filed: Oct. 29, 1979

[51] Int. Cl.[3] ..... D05B 3/00; D05B 53/00

[52] U.S. Cl. ..... 112/65; 112/281; 112/253

[58] Field of Search ..... 112/65, 69, 280, 281, 112/282, 287, 253

[56] References Cited

U.S. PATENT DOCUMENTS

| | | | |
|---|---|---|---|
| 2,650,557 | 9/1953 | Hauser | 112/281 |
| 2,988,031 | 6/1961 | Reid | 112/253 |
| 3,371,632 | 3/1968 | Snyder et al. | 112/281 |
| 3,568,615 | 3/1971 | Strettow | 112/281 |
| 3,721,204 | 3/1973 | Schaffer et al. | 112/281 |

FOREIGN PATENT DOCUMENTS

| | | | |
|---|---|---|---|
| 193144 | 12/1964 | Sweden | 112/281 |
| 757858 | 9/1956 | United Kingdom | 112/281 |

*Primary Examiner*—H. Hampton Hunter
*Attorney, Agent, or Firm*—Barlow & Barlow

[57] ABSTRACT

A system for controlling the starting end of a thread is disclosed in which air is provided via a conduit and nozzle to a point adjacent the needle and above the presser foot of the sewing machine. The arrangement is such that the air is controlled by a valve whose operation is in turn controlled by the position of the presser foot so that air is supplied only when the presser foot is raised and the sewing machine is in a stopped position.

6 Claims, 4 Drawing Figures

THREAD CONTROL FOR BUTTONHOLE SEWING MACHINE

BACKGROUND OF THE INVENTION

This invention relates in general to a system for sewing machines, and more particularly sewing machines that are used for buttonhole operations, where it is desired to keep the starting end of the thread above the presser foot so that the starting thread may be readily cut from the finished buttonhole without being sewn into the fabric if perchance the starting thread gets caught underneath the presser foot.

Attempts to control the starting thread of sewing machines have been somewhat limited and the only approach to the problem known to applicant is that approach shown in the Snyder patent U.S. Pat. No. 3,371,632. In this patent there is disclosed a pair of nozzles which direct air downwardly to the clamp plate so that the downwardly directed air will act upwardly on the starting thread. This arrangement is not positive in its action as it does not insure that in all cases the thread will indeed be kept out of position as it requires a deflection of air rather than immediate direction of air to the thread itself.

SUMMARY OF THE INVENTION

It is therefore an object of the instant invention to improve upon starting thread control devices particularly for buttonhole sewing machines.

It is yet another object of the invention to provide a means for directing air at the needle and starting thread in such a direction that the air is directed away from the operator of the machine and the thread is directed above the bed and more particularly above the presser foot itself.

It is a still further object of the invention to provide a system for controlling the starting thread of a sewing machine, and more particularly a buttonhole sewing machine, in which air is directed at the needle ony when the sewing machine is in a stopped position with a presser foot raised.

Briefly described the present invention can be characterized as a system for controlling the starting thread in a buttonhole sewing macine in which the thread is guided to and through an eye of a reciprocating needle as a system for controlling the position of the starting thread by means of air directed through a nozzle above the presser foot away from the operator so that the thread will extend above the presser foot when the foot is in its raised position. There is also provided valve means to control the amount of air passing through the nozzle together with an on/off spring biased control valve which supplies air to the nozzle only when the presser foot is in the raised condition and the sewing machine is in the stopped condition. An advantage to the system disclosed is that it may be utilized without the use of any additional control mechanisms since the valve that controls the air is automatically actuated by a lever arm that is present on the sewing machine and which is mechanically connected to the presser foot raising and lowering apparatus. Further, the air system of the present invention may be incorporated into existing buttonhole sewing machines without interference with the existing mechanisms that are found on the machine and without interference to the operator thereof.

DESCRIPTION OF THE PREFERRED EMBODIMENT

Figure 1:
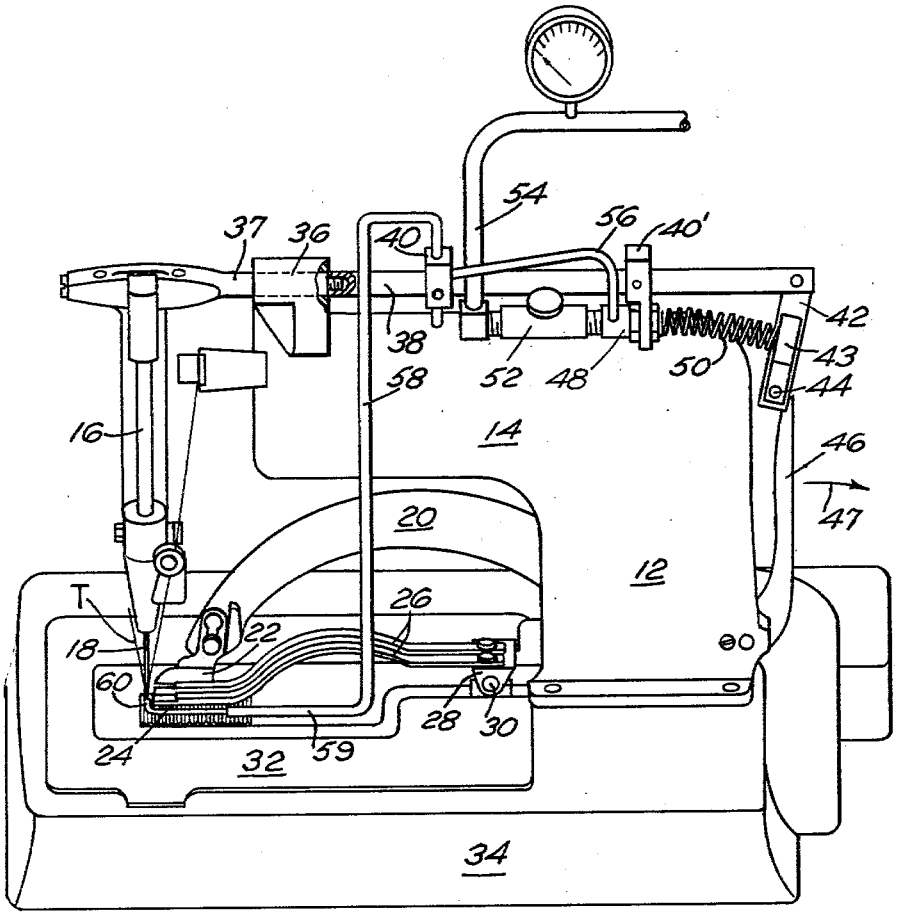
FIG. 1 is a front perspective view of a buttonhole sewing machine showing the attachment for controlling the starting thread in position with parts broken away.
Figure 2:
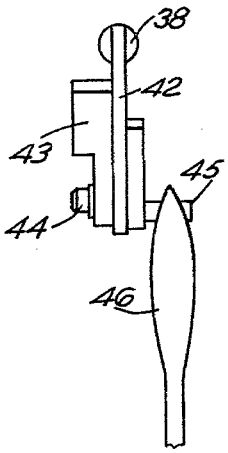
FIG. 2 is a fragmentary end view taken from the righthand side of FIG. 1 showing the means for operating the air control valve.
Figure 3:
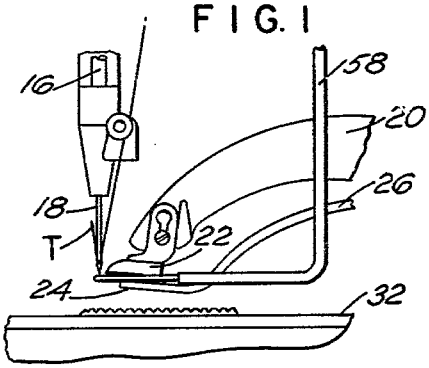
FIG. 3 is a fragmentary elevational view showing the needle and nozzle arrangement together with the presser foot.

With reference to the drawings there is illustrated a sewing machine having a conventional standard 12 with an overhanging arm structure 14 which arm structure carries a reciprocating needle guide rod 16 to which there is attached a needle 18. The machine also carries a cutter arm 20 with a knife means 22 in a conventional manner together with a presser foot 24 which is connected by a pair of arms 26 to a bracket 28 that pivots around a pivot pin 30. The machine also has the usual bed plate 32 on which the fabric to be sewn may be placed. The bed plate 32 and the standard 12 are secured to the main body portion or support table 34 of the sewing machine through which a conventional feeder foot may extend into the bed plate area with its mechanism being hidden from view. As will be appreciated the above described elements are conventional in the sewing machine art and have been described merely to provide proper setting for the instant invention in a rather sketchy fashion.

Attached to the upper portion of the arm 14 is a boss 36 that supports the needle bar 37. Needle bar has a threaded stud extending therefrom and a post 38 is threaded on to this stud. Attached to the post 38 are a pair of blocks or support brackets 40, 40'. The terminal end of the post 38 is bifurcated and carries a pivoting lever 42 that has a block 43 affixed thereto by means of a bolt 44 and a pin 45 extends from one side of the arm 42 for engagement with the manual presser foot handle 46 that rocks toward and away from the standard 12 by normal mechanical actuation of the presser foot.

Figure 4:
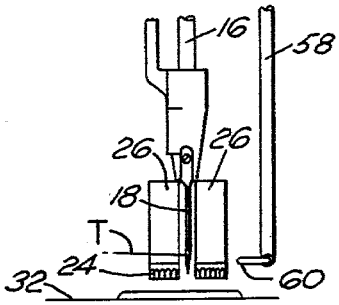
FIG. 4 is a fragmentary end elevational view showing the presser foot in its raised position and the starting thread being projected away by the air nozzle.

Mounted on the post 38 on the block 40' is a valve 48 which will remain in its closed position by the pressure of a compression spring 50 acting against the end portion thereof, which compression spring 50 has its outer end engaged by the plate 43. Serially connected with the valve 48 is a needle valve 52 and fed into the needle valve 52 is a supply of air under pressure coupled thereto by conduit 54. The outlet of valve 48 is found at conduit 56 which is fed into block 40 and thence out through conduit 58 that extends first vertically and thence horizontally as at 59 to turn again at right angles toward the needle 18 where a nozzle 60 is located. Preferably the arrangement is such that the nozzle 60 will be located approximately one-half inch above the presser foot 24 when the same is in raised position (see FIG. 4), and in this fashion the nozzle will virtually line up with the thread hole in the needle 18 so that the thread will extend laterally away as seen in FIG. 4 above the presser foot 24.

The valve 48 which was stated to be normally closed in the position as seen in FIG. 1 of the drawings will be opened when the manual arm 46 moves in the direction of the arrow 47, which movement occurs when the presser foot 24 is mechanically raised by the operation of the machine. Thus, when the presser foot is raised, valve 48 opens and air is directed via conduits 56, 58, 59 out through nozzle 60, which is at right angles to the operator, the air blast directing itself away from the operator so as not to interfere with her positioning of the fabric. It will also be noticed that the manner in which the conduits 58, 59 are arranged that they do not obstruct the operator's functions in any way and do not otherwise interfere with the sewing operation, the air being supplied only when the machine is stopped so as to keep the starting thread above the presser foot 24. The arrangement also speeds up the inspection of the buttonholes and trimming is kept at an absolute minimum. Further it will be apparent that the burst of air which is supplied may be further controlled in its intensity and amount by the needle valve 52 so that only a sufficient amount of air for the purpose desired will be utilized.

Basically the mechanism which has been attached to the conventional buttonhole machine consists essentially of the post 38, its support brackets 40, 40' and valve and conduit means which may be readily attached to an existing sewing machine with very little difficulty and may in many instances be attached to the machine without the necessity of any further drilling particularly in the type of sewing machines where the boss 36 is provided with a thru bore and the post 38 may extend through the boss and be totally supported thereby.

I claim:

1. In combination with a sewing machine having an elongated frame with a bed plate mounted on a support table so that the elongated frame faces the operator, a reciprocable needle having an eye and a presser foot, a source of thread and means guiding the thread to and through said eye of the needle, means holding the thread out of the path of the presser foot comprising a source of air located adjacent the needle above the bed plate to direct the air away from the operator and toward the thread to cause the thread to project above the presser foot when the foot is above the bed plate and means to control the air supply only when the presser foot is above the bed plate.

2. The combination of claim 1 wherein the means directing the air is a nozzle that is oriented transverse to the elongated frame.

3. The combination of claim 1 wherein the means to control the supply of air is a valve actuable to open when the presser foot raises above the bed plate.

4. The combination of claim 1 wherein said machine includes an operating mechanism for the presser foot and the means to control the air supply is coupled to said mechanism.

5. The combination of claim 2 wherein the nozzle is coupled to a conduit and a needle valve is located in the conduit for controlling the discharge from the nozzle.

6. The combination of claim 3 wherein said valve has a spring means normally biasing said valve closed and said valve is mechanically coupled to the presser foot to overcome the spring means upon the raising of the foot away from the bed plate.

* * * * *